US005631432A

United States Patent [19]

Muncy

[11] Patent Number: 5,631,432

[45] Date of Patent: May 20, 1997

[54] STRINGED INSTRUMENT

[76] Inventor: Gary O. Muncy, 128 Oak Dr., Kingston, Tenn. 37763

[21] Appl. No.: 527,006

[22] Filed: Sep. 12, 1995

[51] Int. Cl.[6] ..... G10D 3/00

[52] U.S. Cl. ..... 84/293; 84/314 R

[58] Field of Search ..... 84/293, 314 R, 84/267, 477 R, 485 R

[56] References Cited

U.S. PATENT DOCUMENTS

| | | | |
|---|---|---|---|
| 2,816,469 | 12/1957 | Gossum | 84/314 R |
| 3,787,600 | 1/1974 | Muncy | 84/314 R |
| 4,064,779 | 12/1977 | Petrillo | 84/314 R |
| 4,132,143 | 1/1979 | Stone | 84/314 R |
| 4,137,813 | 2/1979 | Stone et al. | 84/314 R |

*Primary Examiner*—Cassandra C. Spyrou
*Attorney, Agent, or Firm*—Pitts & Brittian, P.C.

[57] ABSTRACT

A guitar fingerboard provided with modular fretboard construction for ease of fretboard replacement, superior fret anchoring bi-directional string bending, and a fretboard design with longitudinal facets cut on a latitudinal arc shape that undulates from fret land areas in high regions to low regions substantially midway between the fret spacing that generates a musical scale progression, for increased playing action. The modular feature is due to a dovetailed form constructed in the fretboard and the neck of the stringed instrument to allow easy and fast replacement of the fretboard. The geometric configuration of the base of the fret, anchors the fret into the fretboard giving it superior stability. The arc facets are formed in a transverse direction to the length of the fretboard and are undulated from high regions at the fret to low regions between the frets by means of a transverse arc form defining fingering regions. The frets are cut on a transverse arc that spans the apex land area of the undulating form, like the arc facets, so that when bending of the string and chords are desired, the strings can be bent in either direction across the arc facet in an unrestricted fashion. The increased action is due to the smooth arc facet form and non-protruding arc land at the apex of the fret.

7 Claims, 2 Drawing Sheets

STRINGED INSTRUMENT

BACKGROUND OF THE INVENTION

This invention relates to stringer instruments and more particularly such instruments in which the strings are positioned over a fretboard such as a guitar, banjo, and the like. Efforts to improve the fingering action, playability, and construction are many by prior luthiers. Prior construction methods have been a fretboard cemented to a separate neck or a fretboard carved into the neck. This process of construction prohibits rapid interehangability for purposes of repair or ascetic considerations.

An earlier arrangement is shown in the U.S. patent of Muncy, U.S. Pat. No. 3,787,600 of 1974, in which the fingerboard was carved into the neck.

Other undulated fingerboards have been made in the past, as shown in U.S patent of Muncy, U.S. Pat. No. 3,787,600 of 1974, with a plane transverse line form undulated with flush frets at the bottom of the groove.

Conventional fretting, shown in U.S. patent of Veres, U.S. Pat. No. 3,481,238 of 1969. showing traditional raised fret form, using tang anchoring, and adhesive fastened fingerboard.

SUMMARY OF THE INVENTION

The present invention overcomes the deficiencies of the arrangements described above in that it provides modular construction by using a dovetailed form to fasten the fingerboard to the neck to allow ease of replacement and ascetic considerations. In the preferred embodiment a dovetail form on the fingerboard, provides a slide in slide out feature for rapid replacement of a worn or damaged fingerboard, while also allowing various wood or other materials selection for grain and color.

I have found that continuous undulating are facets from the high points at the frets to the depressed regions between the frets allows the bending of the strings in either direction to produce vibrato of a note or chord, and allows significantly improved slide noting and slide chording playability. In the preferred embodiment, the fret form is machined into the fingerboard in a manner as to allow a geometric base form to lock the fret in place for added stability.

The object of my invention is to provide a fretboard for a stringed instrument which has modularity of construction for ease of replacement and ascetic considerations.

It is an object of my invention to enhance the stability of the fret in the fretboard.

It is an object of my invention to provide undulating arc facets from high points at the frets to depressed regions between the frets.

An important object of my invention is a provision of a fretboard as outlined above, in which the apex land area is in the form of an arc.

These and other objects and advantages of the invention will become apparent from the following description, the accompanying drawings, and the appended claims.

DESCRIPTION OF PREFERRED EMBODIMENT

Figure 5:
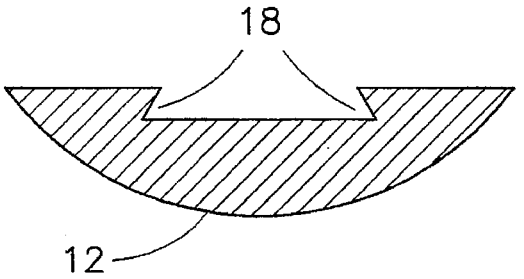
FIG. 5 is and enlarged end view cross-section showing the dovetail in the neck taken generally along the line 5—5 of FIG. 1.
Figure 1:
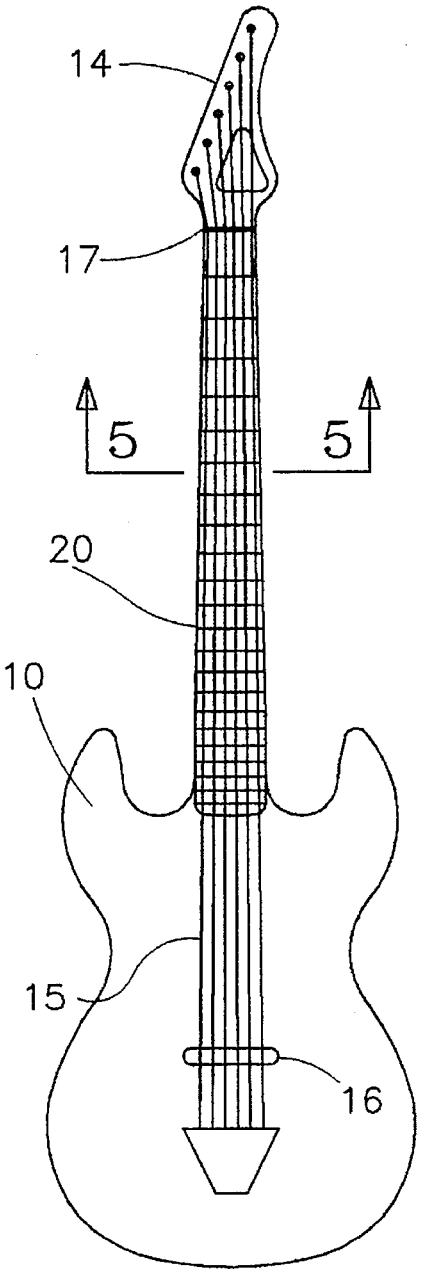
FIG. 1 is a plan view of a guitar embodying my invention.

A guitar having a neck made according to the present invention as illustrated in FIG. 1 is included in the conventional body or base 10, head 14 and in FIG. 5 neck 12. While the invention is shown as being applied to a guitar, it is understood that the same may be applied to any stringed instruments incorporating a neck where spaced frets are, or could be, incorporated; such as a violin.

Figure 2:
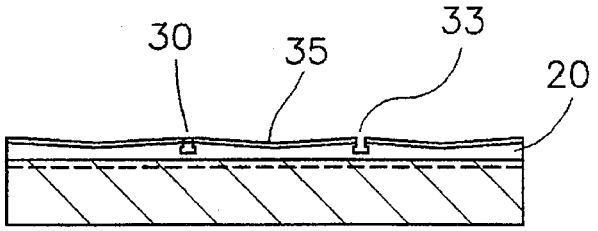
FIG. 2 is an enlarged longitudinal fragmentary section taken through the neck.
Figure 3:
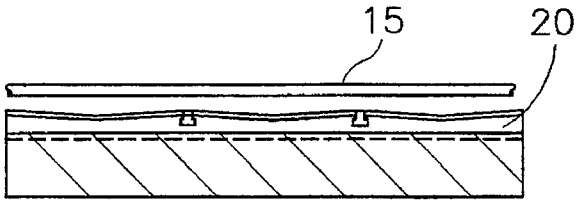
FIG. 3 is an enlarged fragmentary section of a portion of the neck and string.
Figure 4:
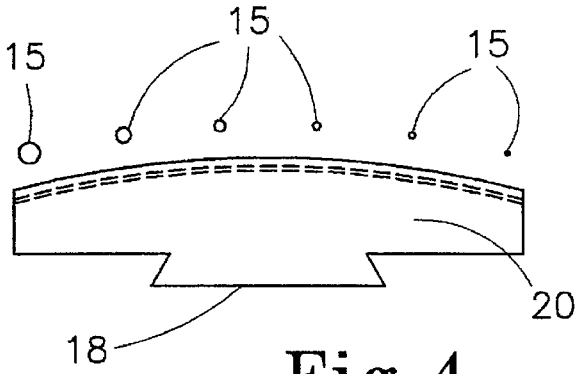
FIG. 4 is an enlarged end view cross-section showing the are and the dovetail of the fingerboard taken generally along the line 5—5 of FIG. 1.

The guitar includes conventional strings 15, illustrated in FIGS. 2, 4, which extend between the bridge 16 and the nut 17 in overlying relation to the fret board portion 20 of the neck 12. The fret board 20 is formed with a dovetail shape 18 assembled with neck 12 with conforming dovetail 18. Either neck 12 or fret board 20 can be utilized with male or female dovetail 18.

While I have shown the modular feature of assembly with dovetailed form, it is within the scope of my invention to utilize other forms of geometric forms of assembly, such as tongue and grooved.

Figure 6:
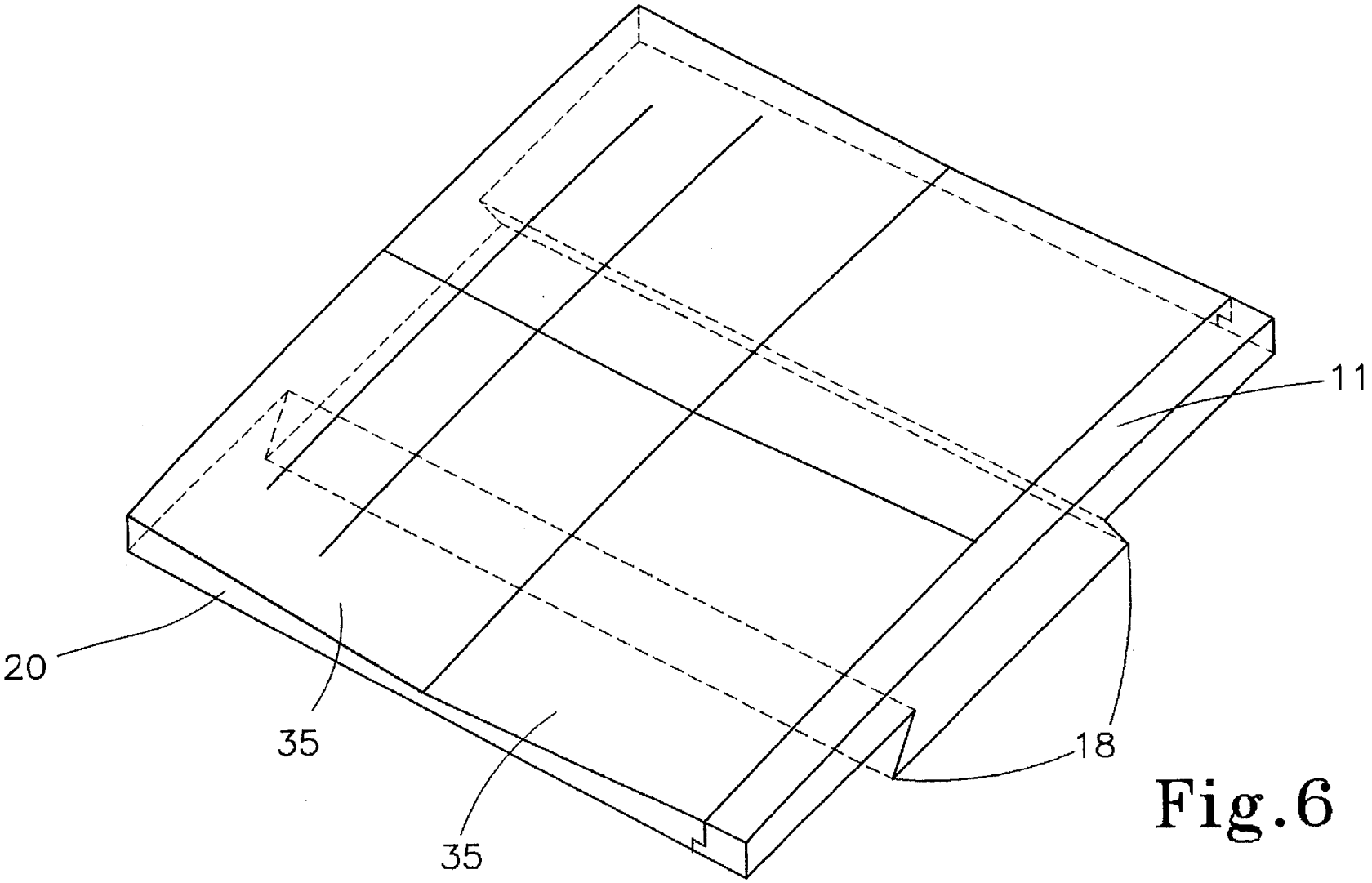
FIG. 6 is an isometric view showing an are facet area and the are land area of the fret taken generally along the line 5—5 of FIG. 1.

The fret 30 is formed geometrically to a T shape as illustrated in FIG. 2. The fret 30 is installed into a matching T-slot 33 cut into the arc land region (FIG. 6) 11 of the fretboard 20 on a corresponding arc.

The fret board 20 is provided with a plurality of transversely extending, longitudinally spaced imbedded frets 30. The frets 30 have playing surfaces which conform to the apex arc land regions 11.

The playing surface of the board 20 is formed with a slight periodic transversely-oriented facets (FIG. 6) 13 which undulates, and is formed on an arc that rise at high points defined as the arc land region 11 of the fret and low points substantially midway between the frets. Preferably the entire playing surface is undulated in this manner, forming an obtuse angle in the playing surface with the apex arc land 11 of the frets. The included angle may be on the order of 170–188 degrees with the result that a slightly depressed region 35 (FIG. 2, 3, 6) is formed between a pair of frets 30. This results in a small portion of the arc facet 13 behind each fret 30 sloping uniformly away from the string 15. The arc, which the facet is formed on, may be on the order of 12" radius but not limited to a 12" radius, and may also be in compound radii configuration.

While the form of apparatus herein described constitutes a preferred embodiment of the invention, is to be understood that the invention is not limited to this precise form of apparatus, and that changes may be made therein without departing from the scope of the invention which is defined in the appended claims.

What is claimed is:

1. A stringed instrument, said stringed instrument being adapted for mounting thereon a plurality of strings, said stringed instrument comprising:

a body;

a neck secured to said body and extending longitudinally therefrom, said neck defining a longitudinally disposed dovetail mortise; and a fretboard positioned for underlying at least a portion of the plurality of strings mounted on said stringed instrument, said fretboard integrally defining a longitudinally disposed dovetail tenon for being slidably received in said dovetail mortise of said neck, said dovetail tenon defining a cross-section for being closely received in said dovetail mortise, whereby said fretboard is removably secured to said neck to facilitate ease of replacement, said fretboard being provide with a plurality of longitudinally spaced frets and defining playing surfaces between adjacent said frets, said playing surfaces defining a pair of connected facets, each said facet including a surface defining a continuous latitudinal are and extending substantially linearly from a high region of said playing surface proximate one of said adjacent frets to a low region where said facets are connected proximate a midway point between said adjacent frets such that, in longitudinal cross-section, said pair of connected facets cooperatively define an obtuse angle.

2. The stringed instrument of claim 1 wherein each fret includes a base portion and an outwardly extending portion so as to define an inverted T-shaped cross-section, and said fretboard is provided with a plurality of laterally oriented inverted T-shaped slots which closely receive said frets, whereby said frets are anchored in said fretboard by said base portions of said frets such that said frets are securely mounted in said fretboard.

3. The stringed instrument of claim 2 wherein said outwardly extending portion of each said fret terminates in an outboard surface which is substantially flush with said playing surfaces of said fretboard adjacent said fret.

4. A stringed instrument, said stringed instrument being adapted for mounting thereon a plurality of strings, said stringed instrument comprising:

a body:

an elongated neck secured to said body and extending longitudinally therefrom, and a fretboard mounted on said neck so as to be positioned for underlying at least a portion of a plurality of strings mounted on said stringed instrument, said fretboard being provide with a plurality of longitudinally spaced frets and defining playing surfaces between adjacent frets, said playing surfaces defining a pair of connected facets, each said facet including a surface defining a continuous latitudinal arc and each said surface of said facet extending substantially linearly from a high region of said playing surface proximate one of said adjacent frets to a low region where said facets are connected proximate a midway point between said adjacent frets such that, in longitudinal cross-section, said pair of connected facets cooperatively define an obtuse angle.

5. The stringed instrument of claim 4 wherein said neck defines a longitudinally disposed dovetail mortise, and wherein said fretboard integrally defines a longitudinally disposed dovetail tenon for being slidably received in said dovetail mortise of said neck, said dovetail tenon defining a substantially solid cross-section for being closely received in said dovetail mortise, whereby said fretboard is removably secured to said neck to facilitate ease of replacement.

6. The stringed instrument of claim 5 wherein each said fret includes a base portion and an outwardly extending portion so as to define an inverted T-shaped cross-section, and said fretboard is provided with a plurality of laterally oriented inverted T-shaped slots which closely receive said frets, whereby said frets are anchored in said fretboard by said base portions of said frets such that said frets are securely mounted in said fretboard.

7. The stringed instrument of claim 6 wherein said outwardly extending portion of each said fret terminates in an outboard surface which is substantially flush with said playing surfaces of said fretboard adjacent said fret.

* * * * *